US008083576B2

(12) United States Patent
Rotter

(10) Patent No.: US 8,083,576 B2
(45) Date of Patent: Dec. 27, 2011

(54) CONTOURED VENTILATION SYSTEM FOR TILE ROOFS

(76) Inventor: Martin J. Rotter, Glenside, PA (US)

( * ) Notice: Subject to any disclaimer, the term of this patent is extended or adjusted under 35 U.S.C. 154(b) by 0 days.

(21) Appl. No.: 11/150,647

(22) Filed: Jun. 10, 2005

(65) Prior Publication Data

US 2006/0019598 A1 Jan. 26, 2006

Related U.S. Application Data

(63) Continuation-in-part of application No. 10/914,455, filed on Aug. 9, 2004, now Pat. No. 6,902,476, which is a continuation-in-part of application No. 10/677,831, filed on Oct. 2, 2003, now Pat. No. 6,773,342.

(60) Provisional application No. 60/415,475, filed on Oct. 2, 2002.

(51) Int. Cl.
*F24F 7/02* (2006.01)
*E04B 7/00* (2006.01)

(52) U.S. Cl. ..... 454/365; 52/199

(58) Field of Classification Search ..... 454/365
See application file for complete search history.

(56) References Cited

U.S. PATENT DOCUMENTS 1,717,728 A 6/1929 Moore
4,876,950 A 10/1989 Rudeen
4,924,761 A 5/1990 MacLeod et al.
5,174,076 A 12/1992 Schiedegger et al.
5,427,571 A * 6/1995 Sells ..... 454/365
5,561,953 A * 10/1996 Rotter ..... 52/198
5,676,597 A 10/1997 Bettoli et al.
(Continued)

FOREIGN PATENT DOCUMENTS

JP 2003343055 A * 12/2003

OTHER PUBLICATIONS

Computer translatin of dosumnt JP 2003343055A, and abstract translation of same document.*

*Primary Examiner* — Steven B McAllister
*Assistant Examiner* — Helena Kosanovic
(74) *Attorney, Agent, or Firm* — Volpe and Koenig, P.C.

(57) ABSTRACT

A profiled ridge vent for tile roofs is provided having a vent strip located on each side of a roof ridge. Each vent strip includes a vent material, formed from a non-woven mat, including a first surface, contoured to a profile to match a profile of the tile roof, and a second surface. An upper water barrier is attached to the second surface of at least one of the vent strips and extends over the roof ridge. A water dam is attached to the first surface and extends in an up-slope direction toward the roof ridge. In use, a first vent strip is located on a first side of a roof ridge pole, and a second vent strip is located on a second side of the roof ridge pole. The upper water barriers of the first and second vent strips overlap one another at the ridge pole. Preferably, adhesive is provided on at least one of the upper water barriers so that the two water barriers are connected together. Alternatively, a single water barrier is provided which bridges the ridge pole and joins the first and second vent strips. Cap shingles which conceal the water barriers are connected to the ridge pole. Ends of the cap shingles rest on portions of the first and second vent strips.

31 Claims, 6 Drawing Sheets

U.S. PATENT DOCUMENTS 5,902,432 A 5/1999 Coulton et al.
6,015,343 A * 1/2000 Castillo et al. ..... 454/365
6,077,159 A 6/2000 Clayton
6,128,870 A * 10/2000 Kohler ..... 52/199
6,128,878 A * 10/2000 Erickson ..... 52/319
6,267,668 B1 7/2001 Morris
6,286,273 B1 9/2001 Villela et al.
6,458,029 B2 * 10/2002 Morris ..... 454/365
6,598,353 B1 7/2003 Reeves
6,695,849 B2 7/2003 Miller
2002/0193065 A1 * 12/2002 Morris et al. ..... 454/365
2003/0140582 A1 7/2003 Sells

* cited by examiner

CONTOURED VENTILATION SYSTEM FOR TILE ROOFS

CROSS REFERENCE TO RELATED APPLICATION

This application is a continuation-in-part of U.S. patent application Ser. No. 10/914,455, filed Aug. 9, 2004, which is a continuation of U.S. patent application Ser. No. 10/677,831, filed Oct. 2, 2003, which claims the benefit of U.S. Provisional Patent Application No. 60/415,475, filed Oct. 2, 2002, all of which are incorporated by reference herein as if fully set forth.

BACKGROUND

This invention is related to the general field of attic and roof ventilation systems. It is particularly related to a roof ridge ventilating system for tile roofs.

It has been a long known practice to ventilate attics under gable roofs by running a vent along the roof ridge. Such vents are created by an open slot running along the roof ridge, essentially the length of the roof, which causes ventilation out of the attic by convection airflow and by suction from wind blowing across the roof.

Differences between the various types of ridge vents are often found in the capping structures used over the vent slot to exclude water and pests. A description of representative types of ridge vents and capping structures, and attributes or problems associated with various types, is found in a prior patent of this inventor, U.S. Pat. No. 5,167,579. That patent discloses, as a solution to many of the problems associated with prior ridge vents, an improved roof ridge venting system using a unitary mat constructed of randomly-aligned synthetic fibers which are joined by phenolic or latex binding agents and heat cured to provide an air-permeable mat with a varying mesh. Cap shingles are supported by the mat and are nailed directly to the roof through the mat. In contrast to other vent materials, the unique features of the mat disclosed in this prior patent result in many desirable physical properties such as high tensile strength, high resiliency, the ability to be transported in rolls and cut to length, ease of joining strips, durability in local ambient conditions, and the ability to act as a water and an insect barrier. Moreover, it provides the aforementioned desirable features in a thin sheet to permit the vent structure to maintain a low profile along the roof ridge.

Although the vent disclosed in the inventor's prior patent has desirable applications in many generally flat roof types, it can not be used in conjunction with contoured roofs or with heavy roofing tiles. As used herein, the phrase "heavy roofing tiles" refers to tiles made from materials which include, but are not limited to, slate, terra cotta, concrete, and clay. These tiles are distinguished by their bulk and weight, as contrasted to the relatively lighter shingles made of asphalt, wood, fiberglass, polymers and the like.

The prior known vent structures useable with such heavy roofing tiles generally included structure to support the capping elements, which are frequently heavy ridge cap tiles of same or similar shape and construction as the roof tiles, for example, as provided in the inventor's prior U.S. Pat. No. 5,326,318. However, the construction of an assembled support from bent-up sheet metal and porous vent material requires shipment in fixed lengths. The cost for making and shipping this type of vent would therefore be high. Additionally, if the roof tiles and cap tiles were "mudded" into position with cement to close the gaps between the overlapping cap tiles, as well as the gaps between the bottom of the cap tiles and the valleys of the roof field tiles along the roof ridge, these gaps, which were intended to remain open for venting in such prior known systems, would likely be filled with cement in accordance with customary roofing practices to prevent leaks, and therefore block any air flow that the vent was intended to provide.

A contoured roof ridge ventilation system for metal roofs has also been developed by the present inventor, and is described in U.S. Pat. No. 5,561,953. This system is intended for use with metal roof panels having a contoured surface, and provides a contoured ventilation strip covered with a flat cap that is nailed to the roof structure. This does not address tile roofs, in which not only the field of the roof is contoured, but also the cap is cylindrical shaped and tiled, such that the bottoms of the cap tiles do not present an even surface, and in which rain driven parallel to the roof ridge may penetrate between the cap tiles.

SUMMARY

The present invention is directed to a novel roof ridge ventilation system which is designed for use with heavy ridge tiles, and to a method of venting such tiled roofs with this novel system. In particular, it is designed for typical tile roofs, wherein the tiles have a generally semi-circular section profile, and are laid in rows alternatingly inverted and overlapped with the preceding row to form an undulating sequence of crests and gutters. The same or similar shaped tiles are then laid along the ridge and affixed to the ridge pole to cap over the vent slot and to impart a rounded appearance to the ridge.

The present invention provides a profiled ridge vent for tile roofs. The vent comprises a vent strip located on each side of the ridge. Each vent strip includes a vent material, preferably formed from a non-woven mat that includes a first surface, contoured to a profile to match a profile of the tile roof, and a second surface. An upper water barrier is attached to the second surface and extends over the roof ridge. A water stop is preferably located beneath the tiles and includes a flange that extends orthogonally to the rows.

BRIEF DESCRIPTION OF THE DRAWINGS

The present invention will be explained in more detail in connection with the drawings in which presently preferred embodiments are shown.

In the drawings.

DETAILED DESCRIPTION OF THE PREFERRED EMBODIMENTS

Figure 1:
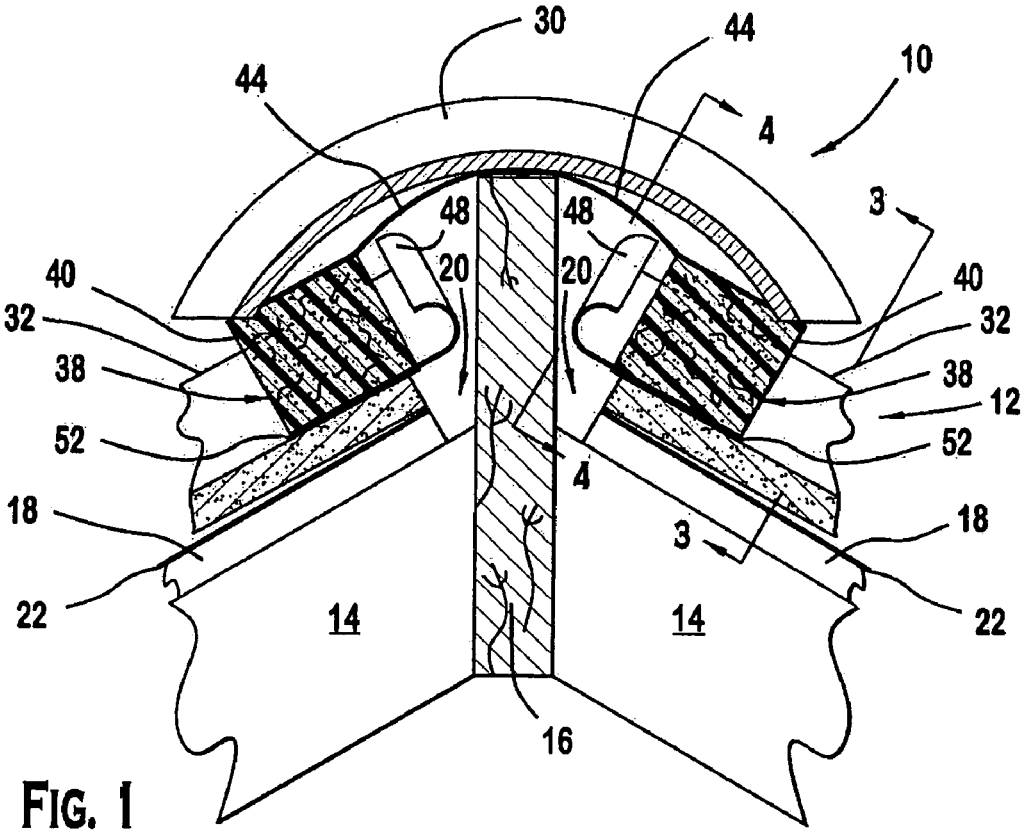
FIG. 1 is a cross-sectional view through a roof ridge showing the contoured ventilation system for tile roofs in accordance with a first preferred embodiment of the present invention.

Certain terminology is used in the following description for convenience only and is not considered limiting. Words such as "front", "back", "top" and "bottom" designate directions in the drawings to which reference is made. This terminology includes the words specifically noted above, derivatives thereof and words of similar import. Additionally, the terms "a" and "one" are defined as including one or more of the referenced item unless specifically noted.

The preferred embodiments of the present invention will be described with reference to the drawing figures where like numerals represent like elements throughout.

Referring now to FIG. 1, a contoured ventilation system 10 for a tile roof 12 is shown. The tile roof 12 includes a roof structure formed from roof rafters 14 that are connected to a ridge pole or beam 16. Sheathing 18 may be applied over the rafters 14, as shown, and a gap or slot 20 is left on each side of the ridge pole 16 for the ridge vent. Alternatively, purlins or other support structures can be utilized. The ridge pole 16 extends above the sheathing 18, or is built up to a desired height, so that the cap shingles 30 for the tile roof 12 can be affixed to it. Roofing felt or another water barrier ("lower water barrier") 22 is applied over the sheathing 18. The roof tiles 32 are then placed in position on the roof until the final, uppermost row of tiles 32 ends at a point below the slots 20.

Figure 2:
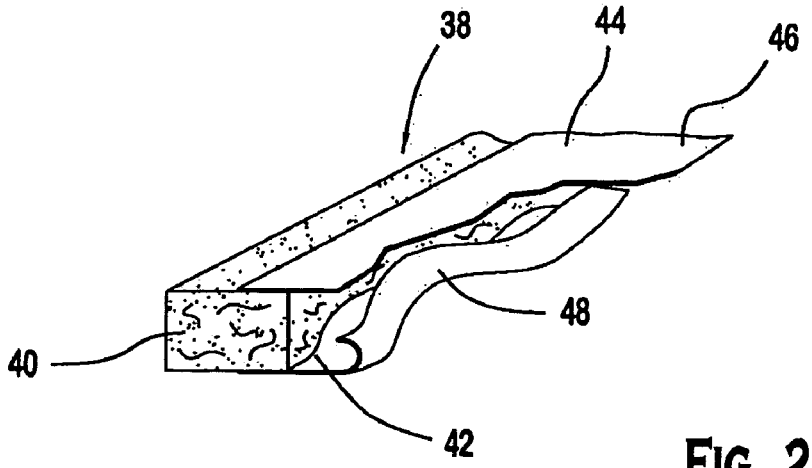
FIG. 2 is a perspective view, partially broken away, of the vent strip used in the contoured ventilation system for tile roofs shown in FIG. 1.

As shown in FIGS. 1 and 2, the ventilation system 10 is comprised of vent strips 38 formed from a contoured strip of vent material 40. The vent material 40 is preferably a non-woven synthetic material that has a high net open free area to allow for air passage therethrough, while acting as a filter to prevent ingress by bugs or debris. The material also prevents moisture permeation, such as wind driven rain, while still allowing air flow for attic ventilation. A preferred material is disclosed in the inventors prior U.S. Pat. No. 5,167,579. However, other suitable mesh materials, whether woven or non-woven may be utilized. The vent material 40 has a first surface 42 which is contoured with a complementary profile to the roof tiles 32, and a second surface, generally opposite to the first surface that is generally flat. The vent material 40 preferably has a thickness that is greater than a depth of the valleys in the roof tiles 32 so that it can be contoured and remain in one piece. The material 40 may be formed as a single piece, or may be made of a plurality of pieces of material that are connected together, such as by adhesives, sewing, heat staking, heat or friction welding or fusion, or any other suitable means. The layers may be made of the same or different materials, with at least one layer of material being air permeable. The vent material 40 is preferably adhered to the roof tiles 32 by an adhesive 52 applied to at least one of the vent material 40 and the roof tiles 32.

An upper water barrier 44 is affixed to the second surface of the vent material 40. The upper water barrier 44 is wide enough so that it will extend over the ridge pole 16 in the installed position, and at least partially overlaps the second surface of the vent material 40. The upper water barrier is preferably made of a closed cell foam material or a polyvinyl chloride or other polymeric sheet material, but may be made from any suitable water resistant material that can be adhered to or affixed to the vent material 40, such as by an adhesive, heat staking, sewing, solvent or heat welding, or by any other suitable means. An adhesive material 46 may be applied to one or both sides of the free ends of the upper water barriers 44, so that upon installation, the upper water barriers 44 from the vent strips 38 overlap and can be adhered to one another. However, this is not required. As shown in FIG. 1, preferably the upper water barrier 44 has some stiffness and is bowed outwardly, toward the underside of the ridge cap tiles 30.

A water dam 48 is preferably attached to the vent strip 38. The water dam 48 is preferably J-shaped, but could also be generally L-shaped. Preferably, one leg of the water dam is attached to the first, contoured surface 42 of the vent material 40 by an adhesive, sewing, heat staking, heat or solvent welding, or through any other suitable attachment means. The water dam 48 is preferably formed from a water resistant polymeric material that has sufficient rigidity that the J shape will be maintained, while also allowing the vent strip 38 to be rolled for shipping.

Figure 5:
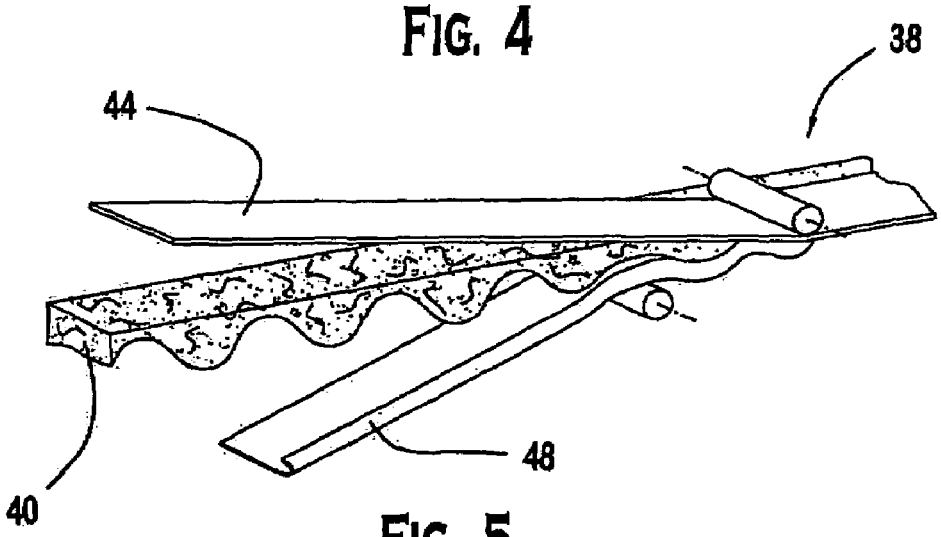
FIG. 5 is a perspective view showing the contoured vent strip being assembled from the contoured vent material, the upper water barrier and the water dam.

Preferably, as shown in FIG. 5, the vent strip 38 is assembled in a continuous process, with the upper water barrier 44 being adhered to the upper surface of the contoured vent material 40, and the water dam 48 being adhered in a continuous strip to the contoured, lower surface 42 of the vent material 40.

Figure 6:
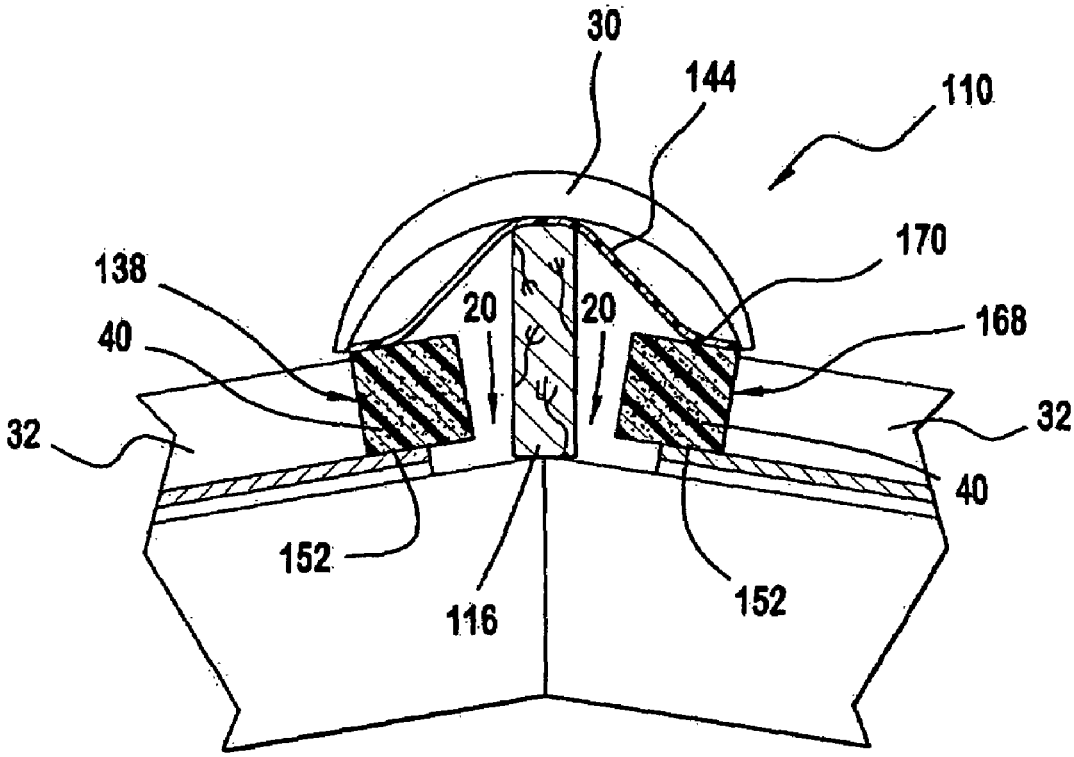
FIG. 6 is a cross-sectional view through a roof ridge showing the contoured ventilation system for tile roofs in accordance with a second preferred embodiment of the present invention.
Figure 7:
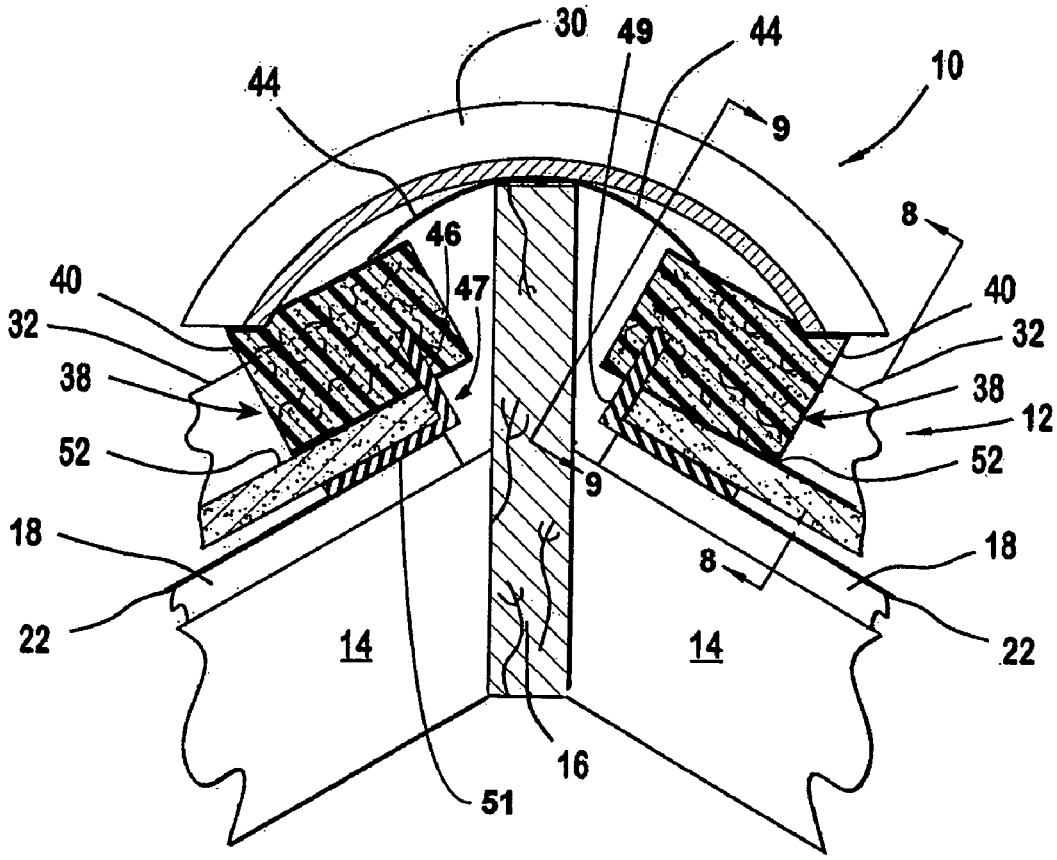
FIG. 7 is a cross-sectional view through a roof ridge showing the contoured ventilation system for tile roofs in accordance with a third preferred embodiment of the present invention.

Making reference to FIG. 6, a ventilation system 110 according to a second preferred embodiment of the present invention is shown. In this embodiment, a single water barrier 144 is attached to a first vent strip 138. The water barrier 144 may be attached to the first vent strip 138 by the procedures described above with reference to the upper water barriers 44 of the first preferred embodiment. A second vent strip 168 is provided without a water barrier to be positioned adjacent to the first vent strip 138 on the opposite side of the ridge pole 116. Adhesive 152 is provided to secure vent strips 138, 168 to the roof tiles in a similar manner to that shown in FIG. 1 with reference to the first preferred embodiment. Additionally, adhesive 170 is provided for attaching a free end of the water barrier 144 to the second vent strip 168 during installation.

Figure 3:
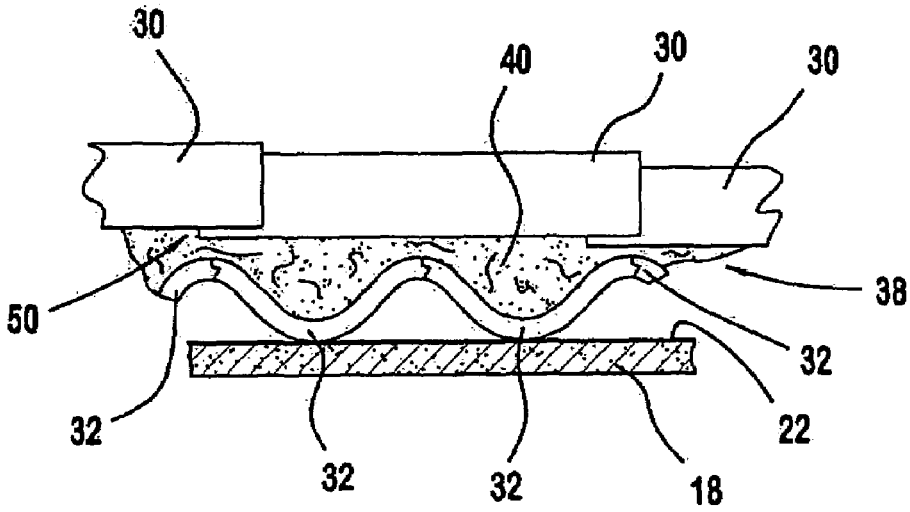
FIG. 3 is a view taken along line 3-3 in FIG. 1.
Figure 4:
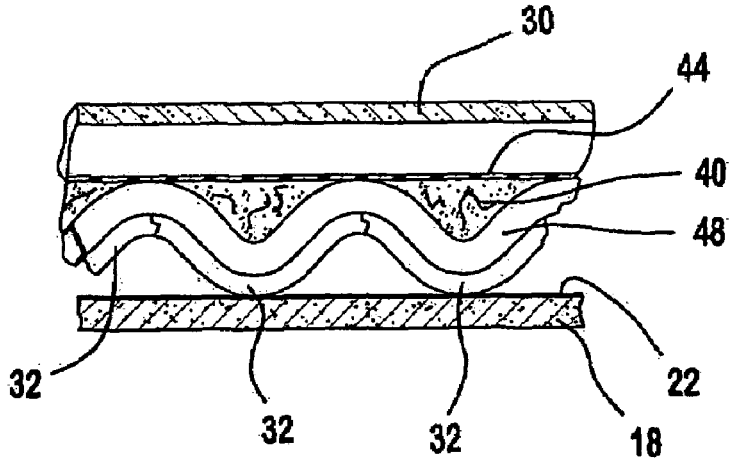
FIG. 4 is a view taken along line 4-4 in FIG. 1.

Referring to FIGS. 1, 3 and 4, for installation of the first preferred embodiment, the vent strips 38 are located on the roof tiles 32 at each side of the roof ridge. The contoured surface 42 of each strip 38 is aligned with the complementary projections and recesses of the roof tiles 32, with the upper water barriers 44 overlapping one another over the ridge pole 16. The adhesive 52 attaches the vent strips 38 to the roof tiles 32. The adhesive 52 may include a fluid or semi-solid substance applied to at least one of the vent strips 38 and the roof tiles 32 during the installation process. Alternatively, the adhesive 52 may include adhesive strips, of the type known in the art, supplied pre-attached along the contoured surface 42 of each vent strip 38. These adhesive strips preferably include a release strip which, when removed, reveals an adhesive such as acrylic or silicone.

Since the two vent strips 38 are not connected together, no specific alignment of the roof tiles 32 on either side of the ridge is required. Additionally, the spacing of the vent strips 38 from the ridge pole 16 can be adjusted to any width of cap tile 30 since the upper water barriers 44 can adjustably overlap one another. If an adhesive is provided on one or both free ends 46 of the upper water barriers 44 of the vent strips 38, the upper water barriers 44 are adhered together. The cap tiles 30 are then installed and preferably connected to the ridge pole 16 with fasteners (not shown).

Referring now to FIG. 6 showing the second preferred embodiment, the first and second vent strips 138, 168 are secured to roof tiles 32, using adhesive 152, in a manner identical to that described above with reference to the vent strips 38 of the first preferred embodiment. After the vent strips 138, 168 are correctly positioned, the water barrier 144, provided on the first vent strip 138, is attached to the second vent strip 168 by an adhesive 170 at installation. The adhesive 170 may include either a liquid or semi-solid adhesive, or alternatively adhesive strips of the type described above, applied to at least one of the second vent strip 168 and the water barrier 144. Adhesive strips are preferably permanently attached to the water barrier 144 and include a release strip which is removed immediately prior to securing the water barrier 144 to the second vent strip 168. The ridge cap tiles 130 are placed over the secured water barrier and rest on the vent strips 138, 168. The ridge cap tiles 130 are preferably installed flush with the water barrier 144 which preferably rests on the ridge pole 116 as shown, but alternatively, two or more of the tiles 30, water barrier 144, and the ridge pole 116 may be installed spaced apart from each other. The ridge cap tiles 130 are also preferably connected to the ridge pole 116 with fasteners (not shown).

As shown in FIGS. 1 and 3 of the first preferred embodiment, the vent material 40 is partially compressed by the cap tiles 30 so that the gaps (indicated at 50) created by overlapping cap tiles 30 are filled. Additionally, in a preferred embodiment where the vent material is at least partially formed of a non-woven synthetic fiber matting as described, for example in U.S. Pat. No. 5,167,579, the vent material 40 is preferably heated so that it "lofts" or expands and is then calendered down to a specific thickness prior to the profiles being cut to match the roof contours. Since the material 40 is calendered, it can also expand somewhat due to sun generated heat on the roof after installation in order to further fill the gaps 50 to prevent the ingress of insects or debris. The cap tiles 131 of the second preferred embodiment, shown in FIG. 6, do not compress the vent material 40. However, alternatively, the cap tiles 131 may be configured to rest on and at least partially compress the vent material as provided in the first preferred embodiment.

In use, the upper water barriers 44, 144 prevent any moisture which may permeate the seams between the overlapping ridge cap tiles 30, 130 from penetrating the roof structure through the slots 20. Any wind driven moisture that is driven up the roof slope is stopped by the vent material 40, and if there is any possible permeation of the vent material 40, the water dam 48 blocks further ingress of the moisture and redirects the moisture back down the roof. Depending on the thickness (in a direction parallel to the roof surface) and porosity of the vent material 40, it is possible that the water dam 48 can be entirely omitted as shown in the second preferred embodiment of FIG. 6.

In one preferred embodiment, the vent material has a maximum height of about 3 inches and a minimum height of about 0.5 inch between the first and second surfaces. The upper water barrier 44 or 144 extends approximately 6 inches from an upper edge of the vent material 40. The water dam 48 has a height of between 0.5 and 1.0 inches. However, different sizes can be used depending on the particular tile roof profile.

FIGS. 7-10 show another preferred embodiment. In this embodiment a water stop 47 has a leg 51 located between the tile 32 and the water barrier 22, and a flange 49 that extends orthogonally from the leg 51. The water stop 47 prevents water that may penetrate from above or beneath the tile 32 from progressing further than the stop 47. The flange 49 is preferably between 0.5 and 1.0 inches long, and the leg 51 is between 1.0 and 3.0 inches long.

Figure 8:
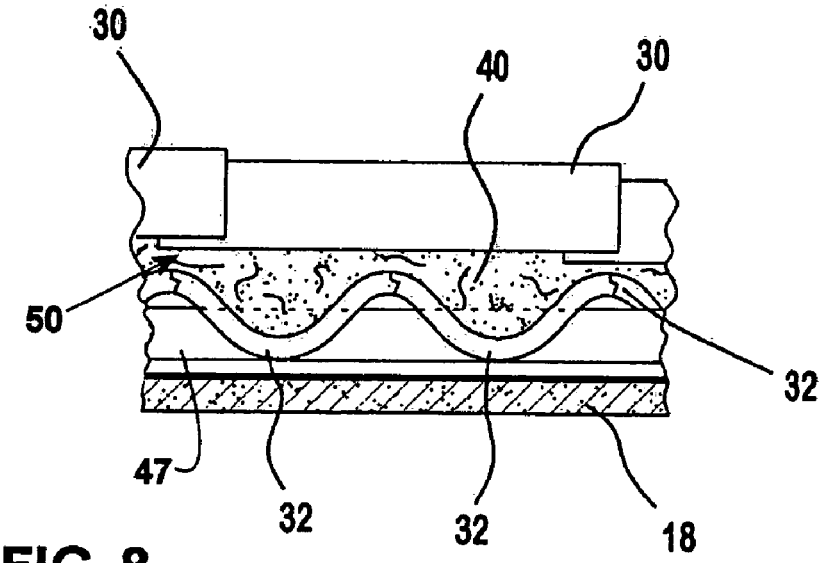
FIG. 8 is a view taken along line 8-8 in FIG. 7.
Figure 9:
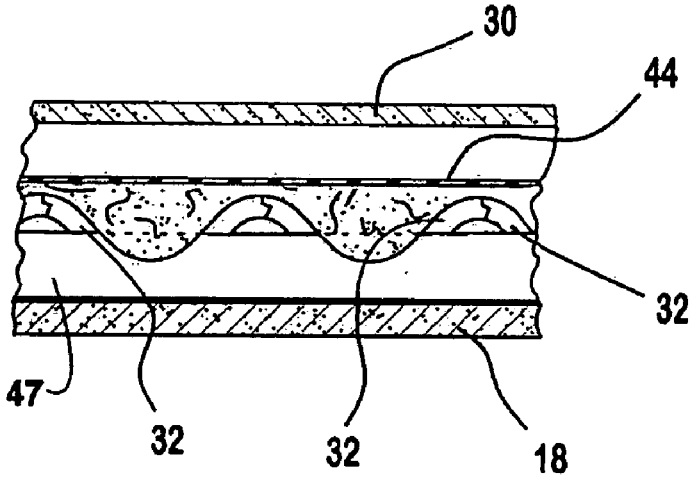
FIG. 9 is a view taken along line 9-9 in FIG. 7.

In the embodiment shown in FIGS. 7-10, the contoured vent material 40 extends beyond the terminal edge of the tile 32 (towards slot 20 as shown in FIG. 1), and has a slit 46 therein that receives the flange 49. Such a slit 46 is not required for the water stop 47, but the slit 46 and flange 49 combination blocks water more effectively. As is best seen in FIGS. 8 and 9, the slit 46 only needs to be cut in the thickest portions of the vent material 40. The flange 49 does not need to extend into the slit 46 along its entire length. The slit 46 and flange 49 engagement secures the vent material 40 in place and also helps prevent passage of excessive water.

Figure 10:
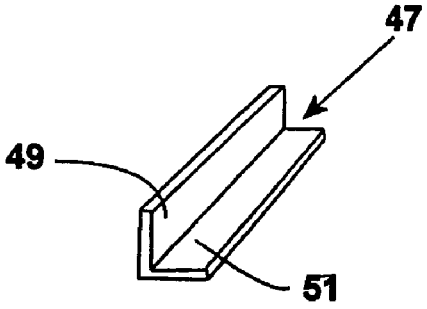
FIG. 10 is a perspective view of the water stop.

As shown in FIGS. 8-10, the water stop can be provided in linear strips or formed from flattened coiled material that is folded to form the leg 51 and flange 49. Further, the water stop 47 can be held in place by applying an adhesive thereto to adhere it to any or all of the water barrier 22, tiles 32, and vent material 40.

Figure 11:
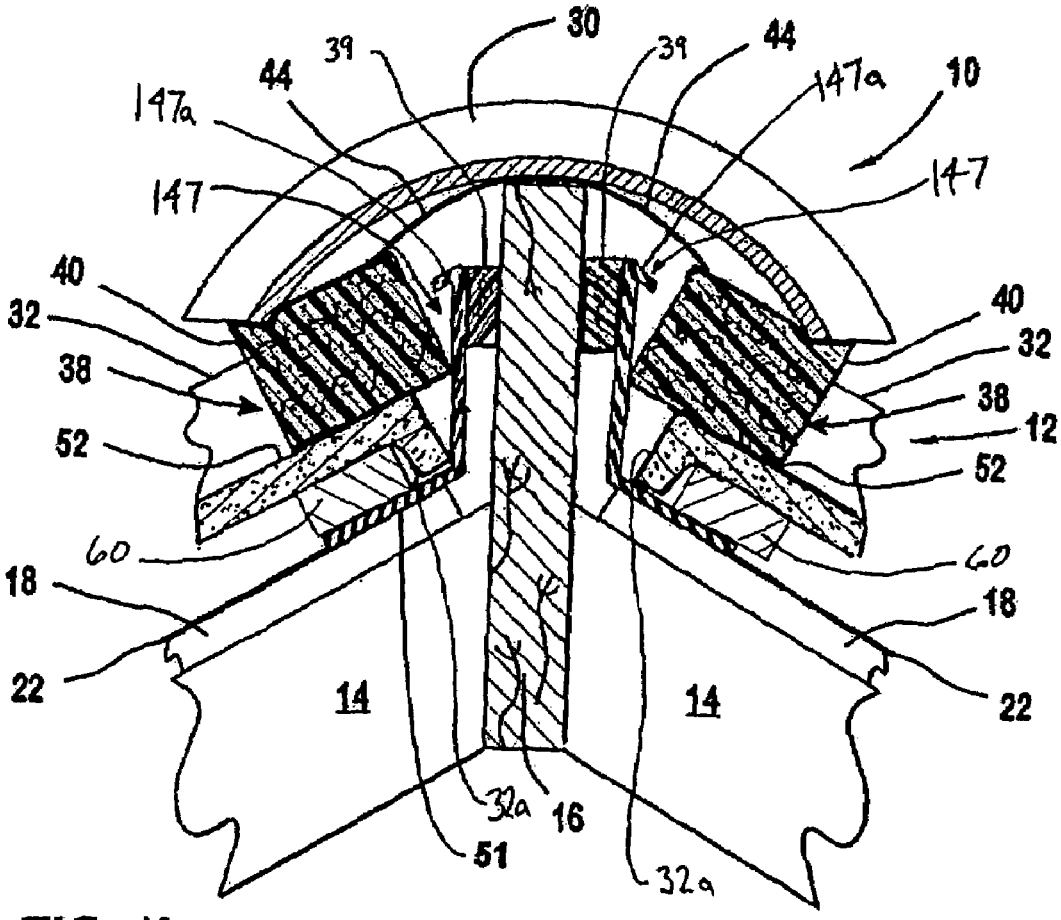
FIG. 11 is a cross-sectional view through a roof ridge showing the contoured ventilation system for tile roofs in accordance with a fourth preferred embodiment of the present invention.

FIG. 11 shows yet another embodiment of the present invention. The tile 32 in this embodiment has a leg **32*a* that extends downward toward the roof 18. The tile 32 rests on a batten 60, preferably made from wood, and the leg 32*a* extends around the upper end of said batten 60. A water stop 147 has a leg 51 that extends from between the batten 60 and the roof 18, and also has a flange (similar to flange 49 in FIG. 7) that is parallel to the ridge pole 16. The flange ends in a lip 147*a* that further discourages moisture ingress. A second non-woven vent strip or water barrier 39 attached to either or both of the ridge pole 16 and the water stop 147, vents air from between the water stop 147 and the ridge pole 16, and prevents moisture ingress. This embodiment, using two vent strips 38 and 39**, is presently preferred.

While the preferred embodiments of the invention have been described in detail, the invention is not limited to these specific embodiments described above which should be considered as merely exemplary. Further modifications and extensions of the present invention may be developed and all such modifications are deemed to be within the scope of the present invention as defined by the appended claims.

What is claimed is:

1. A ventilated tile roof, comprising:

a support structure;

a vent opening through the support structure located along a ridge of the roof;

a plurality of roof tiles located on the support structure defining a plurality of crests and gutters;

a first vent strip located on a first side of the vent opening along the ridge, and having a first surface with a shape having a plurality of crests and gutters that are complementary to the crests and gutters of the roof tiles regardless of contact with the crests and gutters, and a second surface;

a second vent strip located generally parallel to the first vent strip on an opposite side of the roof ridge and having a first surface with a shape having a plurality of crests and gutters that are complementary to the crests and gutters of the roof tiles regardless of contact with the crests and gutters, and a second surface;

at least one upper water barrier positioned above the second surfaces of the first and second vent strips and extending toward the ridge;

first and second water stops located on the respective first and opposite sides of the vent opening along the ridge, each water stop comprising (1) a leg portion extending under the plurality of roof tiles located on the respective side, and (2) a flange extending toward the water barrier; and cap tiles having a lower surface that contacts the second surfaces of the first and second strips or the water barrier located on the first and second strips, wherein the first and second vent strips fill an area between a lower edge of the cap tiles and the gutters of the roof tiles such that the water barrier is pressed against a lower surface of the cap tiles along an entire length of the roof ridge.

2. The ventilated tile roof of claim 1, wherein the first and second strips extend in an upslope direction beyond an upslope edge of the roof tiles into a gap between the edge of the roof tiles and the ridge.

3. The ventilated tile roof of claim 1, wherein the first and second water stops include adhesive applied thereon for securing the first and second water stops in position.

4. The ventilated tile roof of claim 3, wherein the first and second water stops are secured to opposite sides of the ridge and the water barrier over the sheathing on the support structure.

5. The ventilated tile roof of claim 3, further comprising a lower water barrier secured to the support structure and located beneath the first and second water stops.

6. The ventilated tile roof of claim 1, wherein the first and second vent strips are comprised of a non-woven porous material.

7. The ventilated tile roof of claim 6, wherein the non-woven porous material is a synthetic fiber mesh.

8. The ventilated tile roof of claim 1, wherein at least one of the first and second vent materials and the roof tiles includes adhesive applied thereon for securing the first and second vent strips to the roof tiles.

9. The ventilated tile roof of claim 8, wherein the adhesive is a pressure sensitive strip of adhesive having a removable backing which exposes a pressure sensitive adhesive.

10. The ventilated tile roof of claim 1, wherein the water stop extends along a length of the respective vent strip, for preventing ingress of water.

11. The ventilated tile roof of claim 1, wherein the flange abuts against an edge of the roof tiles.

12. The ventilated tile roof of claim 1, wherein the upper water barrier extends between the first and second vent strips and over the ridge.

13. The ventilated tile roof of claim 1, wherein the cap tiles are heavy roofing tiles.

14. The ventilated tile roof of claim 1, wherein the upper water barrier is supported by the ridge.

15. The ventilated tile roof of claim 1, wherein the cap tiles are supported by the ridge.

16. The ventilated tile roof of claim 1, wherein the second surface of each of the first and second vent strips is located opposite the first surface and is generally flat.

17. The ventilated tile roof of claim 1, wherein the second surface of each of the first and second vent strips is located opposite the first surface and is generally planar.

18. A ventilated tile roof, comprising:

a support structure;

a vent opening through the support structure located along a ridge of the roof;

a plurality of roof tiles located above the support structure defining a plurality of crests and gutters;

a first vent strip located on a first side of the vent opening along the ridge, and having a first surface with a shape having a plurality of crests and gutters that are complementary to the crests and gutters of the roof tiles regardless of contact with the crests and gutters, and a second surface;

a second vent strip located generally parallel to the first vent strip on an opposite side of the roof ridge and having a first surface with a shape having a plurality of crests and gutters that are complementary to the crests and gutters of the roof tiles regardless of contact with the crests and gutters, and a second surface;

at least one upper water barrier positioned above the second surfaces of the first and second vent strips and extending toward the ridge;

first and second water stops located on the respective first and opposite sides of the vent opening along the ridge, each water stop comprising (1) a leg portion extending under the plurality of roof tiles located on the respective sides; (2) a flange extending toward the water barrier; and (3) a lip extending generally parallel to the roof tiles from a terminal edge of the flange; and cap tiles having a lower surface that contacts the second surfaces of the first and second strips or the water barrier located on the first and second strips, wherein the first and second vent strips fill an area between a lower edge of the cap tiles and the gutters of the roof tiles such that the water barrier is pressed against a lower surface of the cap tiles along an entire length of the roof ridge.

19. The ventilated roof of claim 18, further comprising:

third and fourth vent strips located between the ridge and first and second water stops, respectively.

20. The ventilated roof of claim 19, further comprising:

battens located on either side of the ridge, each located between the roof tile and the respective water stops.

21. The ventilated roof of claim 20, wherein the roof tile comprises a leg that extends towards the support structure, around an upwards edge of the batten.

22. The ventilated tile roof of claim 19, wherein the first, second, third, and fourth vent strips are comprised of a non-woven porous material.

23. The ventilated tile roof of claim 22, wherein the non-woven porous material is a synthetic fiber mesh.

24. The ventilated tile roof of claim 19, wherein the third and fourth vent strips are secured to opposite sides of the ridge.

25. The ventilated tile roof of claim 19, wherein the upper water barrier extends between the first and second vent strips and over the third and fourth vent strips and the ridge.

26. The ventilated tile roof of claim 18, wherein at least one of the first and second vent materials and the roof tiles includes adhesive applied thereon for securing the first and second vent strips to the roof tiles.

27. The ventilated tile roof of claim 18, wherein the cap tiles are heavy roofing tiles.

28. The ventilated tile roof of claim 18, wherein the upper water barrier is supported by the ridge.

29. The ventilated tile roof of claim 18, wherein the cap tiles are supported by the ridge.

30. The ventilated tile roof of claim 18, wherein the second surface of each of the first and second vent strips is located opposite the first surface and is generally flat.

31. The ventilated tile roof of claim 18, wherein the second surface of each of the first and second vent strips is located opposite the first surface and is generally planar.

* * * * *